US010781728B2

(12) United States Patent
Wanner et al.

(10) Patent No.: US 10,781,728 B2
(45) Date of Patent: Sep. 22, 2020

(54) CAM PHASER KIT

(71) Applicant: ECO Holding 1 GmbH, Marktheidenfeld (DE)

(72) Inventors: Stephan Wanner, Biberach an der Riss (DE); Bernhard Schatz, Ostfildern (DE); Andre Selke, Lohr (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 0 days.

(21) Appl. No.: 16/794,875

(22) Filed: Feb. 19, 2020

(65) Prior Publication Data

US 2020/0208545 A1 Jul. 2, 2020

Related U.S. Application Data

(63) Continuation of application No. PCT/EP2018/074859, filed on Sep. 14, 2018.

(30) Foreign Application Priority Data

Sep. 27, 2017 (DE) ..... 10 2017 122 425

(51) Int. Cl.
*F01L 1/34* (2006.01)
*F01L 1/344* (2006.01)

(52) U.S. Cl.
CPC ... *F01L 1/3442* (2013.01); *F01L 2001/34433* (2013.01); *F01L 2303/00* (2020.05)

(58) Field of Classification Search
CPC ..... F01L 1/3442; F01L 2303/00; F01L 2001/34433
See application file for complete search history.

(56) References Cited

U.S. PATENT DOCUMENTS 6,799,544 B1 10/2004 Pierik
2013/0000578 A1* 1/2013 Cole ..... F01L 1/3442 123/90.17

FOREIGN PATENT DOCUMENTS

| | | | |
|---|---|---|---|
| DE | 19908146 | A1 | 8/2000 |
| DE | 102008051145 | A1 | 4/2010 |
| DE | 102013223112 | A1 | 6/2014 |
| DE | 102015214725 | A1 | 2/2017 |

* cited by examiner

*Primary Examiner* — Zelalem Eshete
(74) *Attorney, Agent, or Firm* — Von Rohrscheidt Patents

(57) ABSTRACT

A kit including a cam phaser, including a central valve that is configured to distribute a pressure fluid, and an actuator that controls the central valve, a rotor that is rotatably supported in a stator, wherein the cam phaser is driven or drivable by a dry running traction drive, wherein a pressure fluid distribution chamber that is fillable with the pressure fluid through the central valve is provided between the cam phaser and the actuator, wherein the pressure fluid distribution chamber is connected with an armature chamber of the actuator and sealed towards an ambient, wherein the actuator includes at least one armature that is movable by a coil, a pole core and a pole tube that form a pole tube assembly, and wherein the pressure fluid distribution chamber is sealed by a bonded or friction locking and form locking connection of the actuator with the central valve.

14 Claims, 5 Drawing Sheets

CAM PHASER KIT

RELATED APPLICATIONS

This application is a continuation of International Application PCT/EP2018/074859 filed on Sep. 14, 2018 that claims priority from and German Patent Application DE 10 2017 122 425.4 filed on Sep. 27, 2017, both of which are incorporated in their entirety by this reference.

FIELD OF THE INVENTION

The invention relates to a kit including a cam phaser including a central valve that distributes a pressure fluid and an actuator that controls the central valve, wherein the cam phaser is driven by a dry running traction drive, e.g., a belt, and wherein the cam phaser includes a rotor that is rotatably supported in a stator.

BACKGROUND OF THE INVENTION

Kits including a cam phaser and a central valve are known, e.g., from DE 10 2015 214 725 A1. When the cam phaser is driven by a belt, the cam phaser and any component that is operatively connected therewith has to be sealed.

BRIEF SUMMARY OF THE INVENTION

It is an object of the invention to provide a cam phaser kit that is improved over the prior art and that provides sealing with a simple and economic configuration.

The object is achieved by a kit including a cam phaser, including a central valve that is configured to distribute a pressure fluid, and an actuator that controls the central valve, a rotor that is rotatably supported in a stator, wherein the cam phaser is driven or drivable by a dry running traction drive, wherein a pressure fluid distribution chamber that is fillable with the pressure fluid through the central valve is provided between the cam phaser and the actuator, wherein the pressure fluid distribution chamber is connected with an armature chamber of the actuator and sealed towards an ambient, wherein the actuator includes at least one armature that is movable by a coil, a pole core and a pole tube that form a pole tube assembly, and wherein the pressure fluid distribution chamber is sealed by a bonded or friction locking and form locking connection of the actuator with the central valve. Advantageous embodiments with useful and non-trivial improvements of the invention are provided in the dependent claims.

A kit with a cam phaser is proposed including a central valve that distributes a pressure fluid. The kit furthermore includes an actuator that controls the central valve, wherein the cam phaser is driven or drivable by a dry running traction drive and includes a rotor that is rotatably supported in a stator. A pressure fluid distribution chamber that is fillable with a pressure fluid through the central valve is provided between the cam phaser and the actuator wherein the pressure distribution chamber is connected with an armature chamber of the actuator and sealed towards an ambient. The actuator includes at least one armature that is movable by a coil, a pole core and a pole tube that form a pole tube assembly.

According to the invention the pressure fluid distribution chamber is sealed by a bonded and/or friction-locking and form-locking connection of the actuator or one or plural actuator components with the central valve. Complex sealing by a separate seal element can be advantageously omitted.

The sealing concept according to the invention is applicable in embodiments where the actuator is connected torque proof and sealed not at the central valve itself, but at an end of the cam shaft or at a component that is arranged at the end of the cam shaft.

According to an advantageous embodiment of the invention, the armature of the actuator can be axially movable in a sleeve, wherein the sleeve is bonded to the central valve, in particular by welding or gluing. The sleeve facilitates a magnetic separation of the armature and the pole tube assembly. The armature can be turned economically from machining steel.

Advantageously the sleeve is provided without chipping in a thin configuration and has a coating that is produced by plasma nitrogen hardening. This wear resistant sliding coating facilitates to fabricate the sleeve thin without running the risk that the sleeve wears during a very long service life or loses wall thickness.

According to another advantageous embodiment the pole tube and/or the pole core includes plural axially extending centering ribs at an inside of the pole core that are advantageously integrally molded from a synthetic material. The centering ribs facilitate simple and effective centering of the outer actuator components.

An alternative embodiment of the invention provides that the pole core of the actuator is connected with the central valve by bonding, in particular by welding or by gluing. The coil and the remaining outer actuator components are radially centered on the subassembly including the pole tube assembly and the central valve and are axially positioned and radially positioned in a component that is fixed at the engine. This facilitates simple compensation of tolerances in subassemblies so that the actuator only has to produce a minimum required stroke. Thus, installation space can be additionally reduced. By the same token, it is not necessary to provide clearance compensation for coaxial misalignments.

An embodiment of the invention that is producible in a particularly simple and cost-effective manner provides that the pole core of the actuator is connected with the central valve in a friction-locking and form-locking manner, in particular by a press fit.

Thus, the pole core can advantageous form a subassembly together with the pole tube that can be preassembled, wherein an intermediary ring that is non-magnetizeable and produced by a thermal method is provided between the pole tube and the pole core and bonds the pole tube with the pole core. Alternatively the pole core can form a pole tube assembly together with the pole tube wherein the pole tube and the pole core are integrally provided in one piece.

According to an advantageous embodiment of the invention, a coil body of the coil includes plural centering ribs made from a synthetic material provided on an inside of the coil body and integrally provided by injecting molding. The centering ribs facilitate simple centering and are formable at the coil body in a cost-effective manner.

According to another advantageous embodiment of the invention, at least the coil including the coil body and a housing of the actuator are radially centered on the pole tube assembly by at least one straight bearing. The at least one straight bearing facilitates minimizing gaps between the pole tube assembly and the pole disks. When the at least one straight bearing includes PFTE as an additional material this provides a bearing with very little wear that is also suitable for high circumferential velocities.

An advantageous embodiment provides that a single straight bearing made from a non-ferrous base material is arranged between the coil body and the pole tube assembly. This straight bearing can be encased with the remaining outer actuator components by injection molding. The arrangement in the portion of the coil body facilitate simple minimization of the gaps between the pole tube assembly and pole disks without additional installation space.

According to an alternative advantageous embodiment, two sliding bearings made from a ferrous base material are arranged axially outside of a magnetic circuit.

Advantageously a seal element can be provided for additional sealing between the cam phaser, in particular the stator and the central valve.

According to an advantageous embodiment, a support element can be provided between the cam phaser, in particular the stator and the central valve.

BRIEF DESCRIPTION OF THE DRAWINGS

Additional advantages, features and details of the invention can be derived from the subsequent description of advantageous embodiments and from the drawing figures. The features and feature combinations recited in the preceding description and in the subsequent figure description and/or in the figures shown by themselves are not only usable in the respectively shown combination, but also in other combinations or by themselves without departing from the spirit and scope of the invention, wherein.

DETAILED DESCRIPTION OF THE INVENTION

Figure 1:
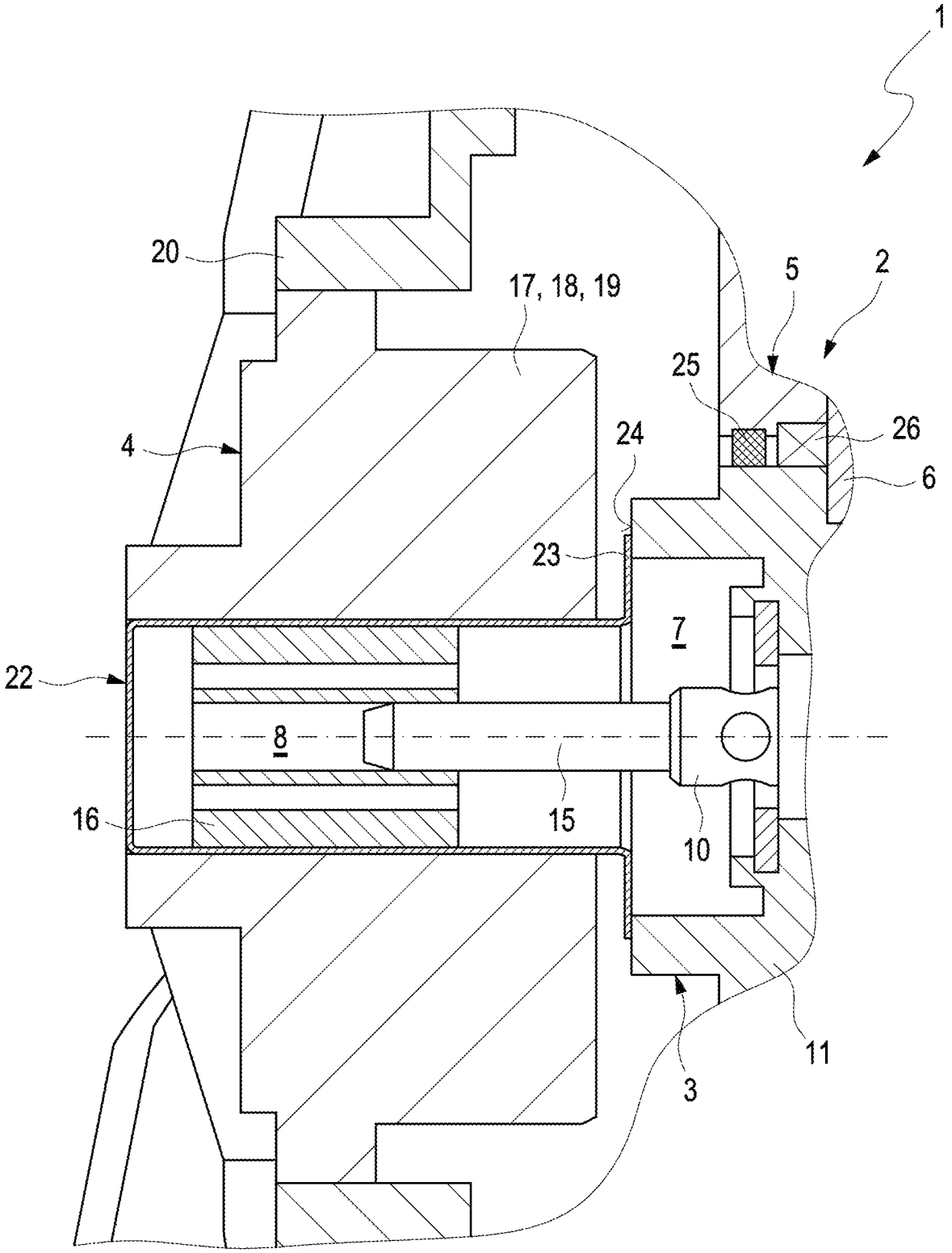
FIG. 1 illustrates a schematic detail view of a first embodiment of a kit according to the invention in a longitudinal sectional view.

FIG. 1 illustrates a first embodiment of a kit 1 including a cam phaser 2 in which a central valve 3 is provided that distributes a pressure fluid.

The cam phaser 2 is configured to adjust a cam shaft that is not illustrated in FIG. 1. The central valve 3 includes a piston 10 that is axially moveable in a valve housing 11 and that is moved by an electromagnetic actuator 4.

Plural operating connections are provided in the valve housing 11 in order to hydraulically supply the cam phaser 2.

Figure 2:
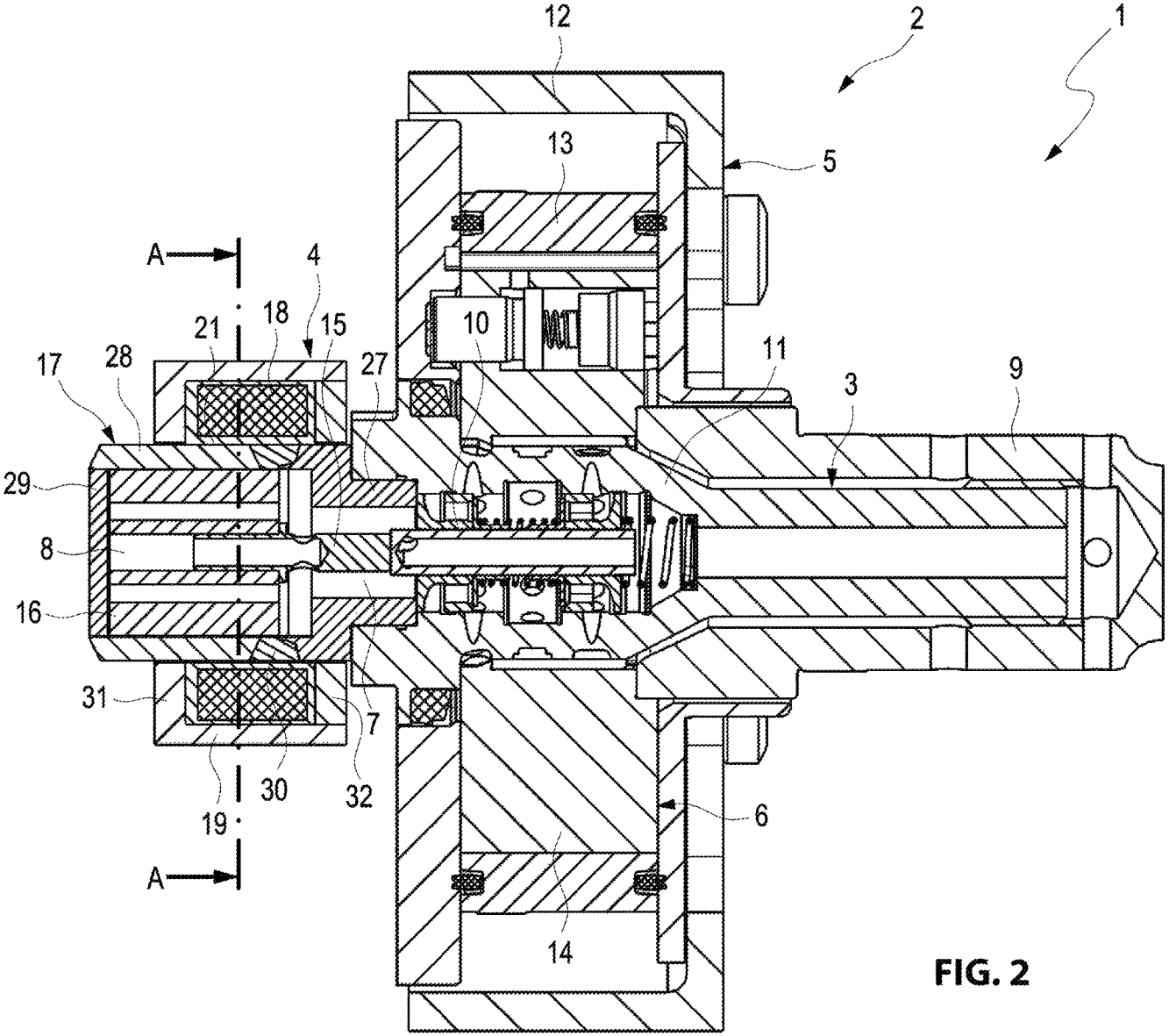
FIG. 2 illustrates a schematic detail view of a second embodiment of a kit according to the invention in a longitudinal sectional view.
Figure 3:
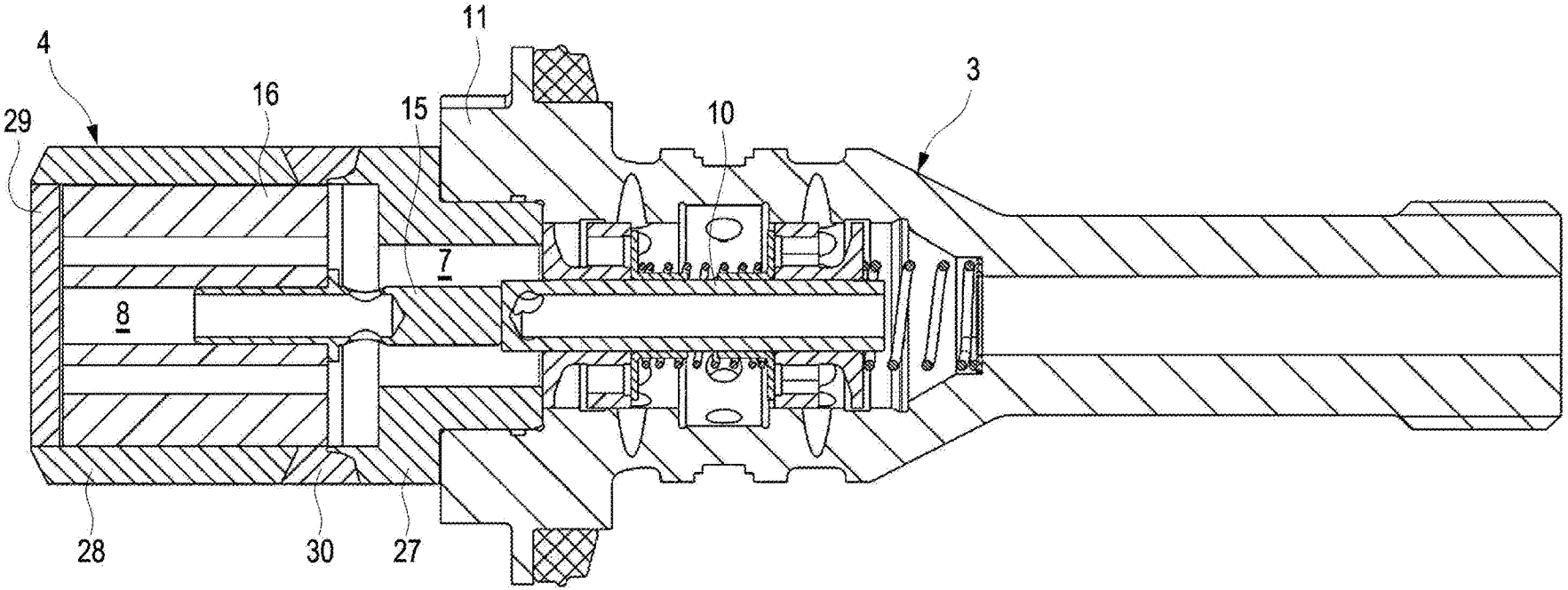
FIG. 3 illustrates a central valve/actuator assembly of the kit according to FIG. 2 in a longitudinal section view.
Figure 4:
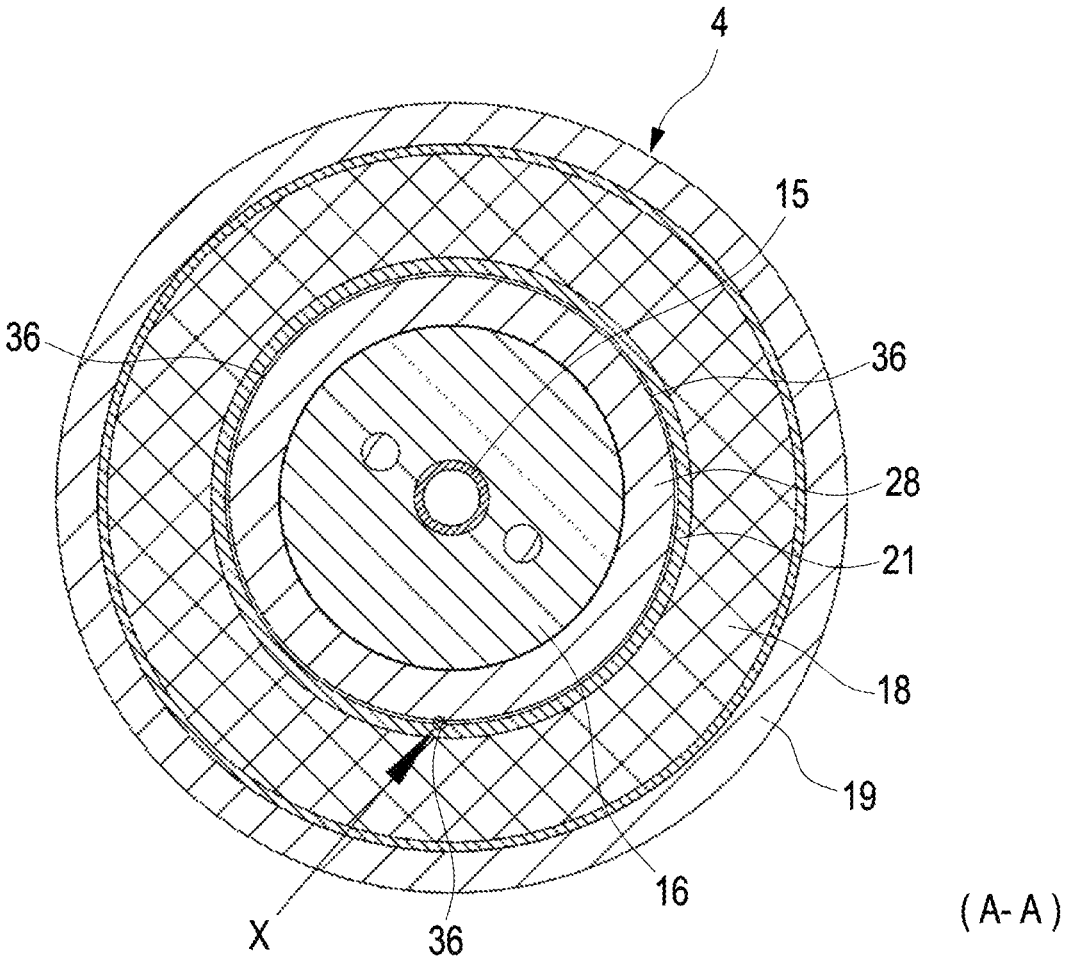
FIG. 4 illustrates a cross-sectional view A-A of the central valve/actuator assembly of the kit according to FIG. 2.
Figure 5:
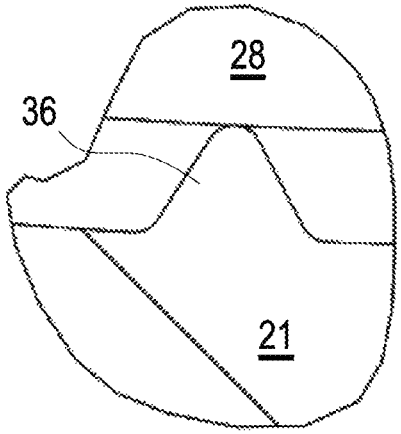
FIG. 5 illustrates a blown-up detail X of the cross section A-A according to FIG. 4.

The central valve 3 and the actuator 4 are only partially and schematically illustrated in FIG. 1. Further details can be derived from FIG. 2 which illustrates another embodiment of the kit 1.

The cam phaser 2 facilitates adjusting opening and closing times of gas control valves in a cylinder head of an internal combustion engine during operations. Thus, the cam phaser 2 continuously adjusts an angular orientation of a camshaft of the internal combustion engine that is rotatably received in the cylinder head relative to a crankshaft of the internal combustion engine, wherein the camshaft is rotated relative to the crankshaft. Rotating the camshaft adjusts opening and closing timing of the gas control valves so that the internal combustion engine can develop optimum power at a respective speed.

The cam phaser 2 is driven or drivable by a dry running traction drive, e.g., a belt and includes a stator 5 that is connected torque proof with a belt pulley 12. The drive belt is run as a drive element over the belt pulley 12. The stator 5 is operatively connected with the crankshaft through the belt and the belt pulley 12. The stator 5 and the belt pulley 12 can be made from separate components or can be provided integrally in one piece. The belt pulley 12 can form e.g. a cylindrical stator base element and a cover.

Radially inward protruding bars are provided in uniform intervals at insides of the stator 5 or the stator base element 13 so that an intermediary space is formed between two respective adjacent bars. A vane 14 of a rotor hub of a rotor 6 of the cam phaser 2 that is rotatably supported in the stator 5 is arranged so that the vane protrudes into the intermediary space. Corresponding to a number of intermediary spaces the rotor hub includes a number of vanes 14. Thus, the vanes divide each intermediary space into two pressure cavities. A pressure medium, typically a hydraulic fluid, is controlled by the central valve 3 and introduced into the intermediary spaces.

A pressure chamber is associated with each operating connection. Thus, the first pressure chamber is associated with the first operating connection and the second pressure chamber is associated with the second operating connection. In order to change an angular relationship between the cam shaft and the drive wheel and thus the crank shaft the rotor is rotated relative to the stator. For this purpose hydraulic fluid is fed into the pressure chambers depending on a desired direction of rotation while respective other pressure chambers are released into a tank. In order to pivot the rotor relative to the stator counter clockwise a first operating connection is pressurized by the central valve and a second operating connection is unloaded. In order to pivot the rotor clockwise the second operating connection is pressurized by the central valve and the first operating connection is unloaded. The unloading is performed through at least one tank connection, wherein the hydraulic fluid can drain through the tank connection.

The piston 10 of the central valve 3 is moved by a plunger 15 of the actuator 4 that is fixed in an armature 16 and axially movable together with the armature 16 along a longitudinal axis of the actuator 4.

The actuator 4 includes a pole tube assembly 17 that is not illustrated in FIG. 1 and that is arranged within a cylindrical coil 18 that generates a magnetic field, and a housing 19 which is attached directly or using an adapter in an engine component 20 like e.g. a cylinder head. The coil 18 and the pole tube assembly 17 form a magnet circuit with the pole discs 31, 32. One or both pole discs 31, 32 can be configured integrally in one piece with the housing 19. It is also conceivable to integrally envelop the housing 19 and the pole discs 31, 32 and the coil 18 with an additional synthetic material housing.

The coil 18 is received in a coil body 21 that is made from synthetic material and that envelops the pole tube assembly at least partially.

In a first embodiment illustrated in FIG. 1 the armature 16 is received axially movable in a sleeve 22. The sleeve 22 is advantageously provided thin and produced by a non-chipping method and includes e.g. a coating that produced by plasma nitrogen hardening. The armature 16 can be turned in a cost effective manner from machining steel. The extremely wear resistant sliding coating facilitates producing the sleeve 22 thin without running the risk that the sleeve 22 wears during a very long service life or loses wall thickness.

A pressure fluid distribution chamber 7 that is fillable with pressure fluid through the central valve 3 is provided between the cam phaser 2 and the actuator 4 wherein the pressure distribution chamber is flow connected with an armature chamber 8 of the actuator 4. It is evident that the pressure fluid distribution chamber 7 is provided within the valve housing 11 and extends between the piston 10 and the armature chamber 8. The pressure fluid distribution chamber 7 is sealed towards and ambient in order to keep the belt drive portion free from hydraulic fluid/pressure fluid in order to provide a reliable drive.

The first embodiment provides that the sealing of the pressure fluid distribution chamber 7 is provided by a bonded connection of the actuator 4 or of one or plural actuator components with the central valve 3 or with a central valve component.

As evident from FIG. 1 a circumferential shoulder 23 of the sleeve 22 is welded or glued tight with an axial face 24 of the valve housing 11. Laser welding can be used for a welding method. Thus, the sleeve 22 is provided torque proof with the central valve 3 and thus with the cam shaft 9.

The sleeve 22 that is bonded with the housing 11 is rotatably supported by the connection in the non-illustrated pole tube assembly 17 which can be configured in one component or in plural components and which is fixed at the non-moving engine component 20 like the other external components of the actuator 4.

In order to center the sleeve 22 in the pole tube assembly plural, advantageous 3 axial centering ribs made from synthetic material can be integrally molded on an inside of the pole tube assembly and evenly distributed over a circumference. The axial centering ribs facilitate exact alignment and centering during assembly of the remaining actuator components, thus coil 18, pole tube assembly 17 and housing 19 and assure a required small air gap. Separate seal elements and a labor intensive fabrication of sealing surfaces between the actuator 4 and the cam phaser 2 can thus be omitted.

In order to improve robustness of the kit 1 a portion of the pole tube assembly 17, in particular a pole core can be additionally bonded, in particular by welding or gluing with the face 24 of the central valve 3. A seal element 25 can be additionally provided between the stator 5 and the central valve 3 in order to provide additional sealing. Furthermore support can be provided by a suitable bearing 26 between the stator 5 and the central valve 3.

The embodiment of FIGS. 2-5 differs from the first embodiment according to FIG. 1 in that the actuator 4 does not have a sleeve and the actuator 16 is movably supported in the pole tube assembly 17 in this embodiment.

A pressure fluid distribution chamber 7 that is fillable with the pressure fluid through the central valve 3 is provided between the cam phaser 2 and the actuator 4 wherein the pressure fluid distribution chamber is connected with an armature cavity 8 of the actuator 4. It is evident that the pressure fluid distribution chamber is provided within a pole core 27 of the pole tube assembly 17 and extends between the piston 10 of the central valve 3 and the armature chamber 8. The pressure fluid distribution chamber 7 is also sealed in this embodiment towards the ambient in order to keep the belt drive portion free from hydraulic fluid or pressure fluid in order to provide a reliable drive.

In order to seal the pressure fluid distribution chamber 7 the pole core 27 of the actuator 4 is connected with the central valve 3 friction locking and form locking, in particular by a press fit, this means connected torque proof with the valve housing 11. In this embodiment the pole tube assembly 17 includes the pole core 27, a pole tube 28 and a base 29 that is connected tight with the pole tube 28. An additional bonded connection of the pole core 27 with the valve housing 11 is conceivable.

Advantageously a non-magnetizeable spacer ring 30 that is produced by a thermal method can be provided between the pole tube 28 and the pole core 27, wherein the spacer ring bonds the pole tube 28 and the pole core 27.

The pole tube assembly 17 that is connected with the valve housing 11 form locking and friction locking is rotatably supported by this connection in the coil 18, this means in its coil body 21 which is fixed at the non-moving engine component 20 like the housing 19 and the pole discs 31, 32.

In order to center the coil body 21 of the coil 18 plural, advantageously three circumferentially evenly distributed axial centering ribs 36 made from synthetic material are integrally molded on an inside of the coil body 21. These ribs facilitate precise alignment and centering during assembly of the remaining actuator components, (coil 18, coil body 21 and housing 19 and facilitate keeping a required small air gap. Separate sealing elements and a labor intensive production of sealing surfaces between the actuator 4 and the cam phaser 2 can thus be omitted.

The housing 19 of the actuator 4 which can be additionally encased by injection molding with an additional synthetic material housing as described supra is also attached directly or by means of an adapter in a non-moving engine component 20 like a cylinder head in this embodiment.

Figure 6:
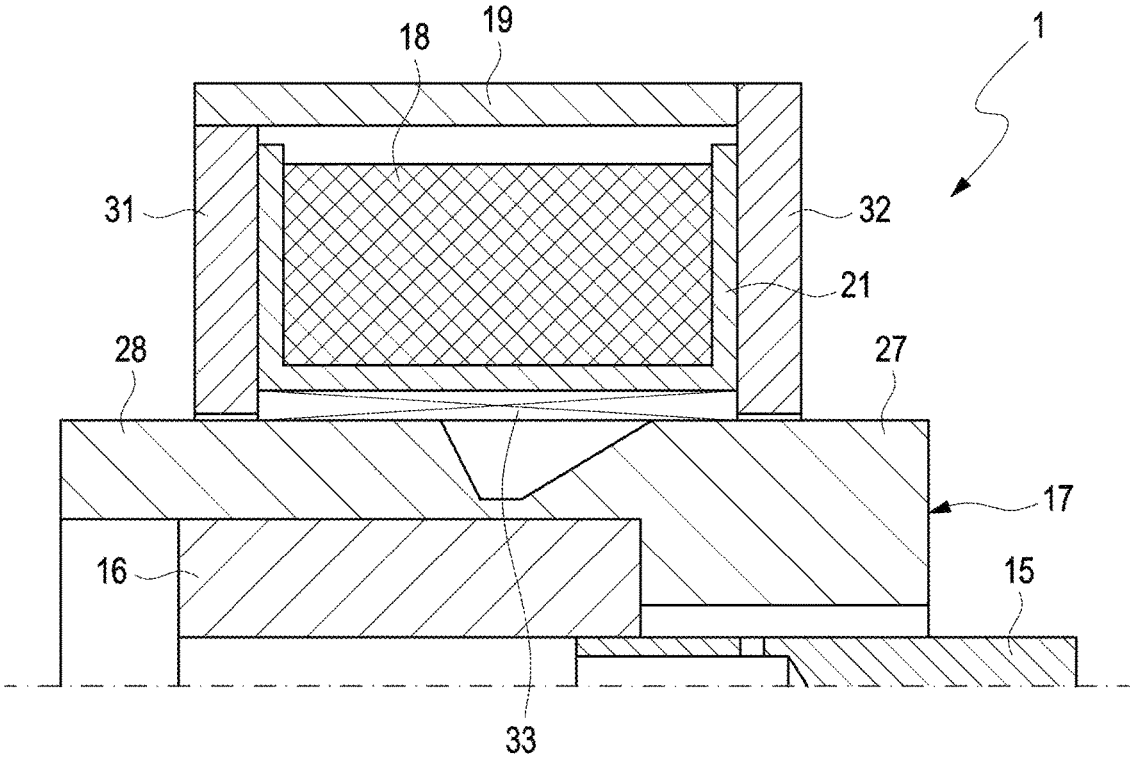
FIG. 6 illustrates a detail of a third embodiment of a kit according to the invention in a longitudinal sectional view.

FIG. 6 illustrates a detail of a third embodiment of a kit 1 according to the invention in which the pole core 27 of the pole tube assembly 17 is connected torque proof with the non-illustrated central valve 3, similar to the preceding body. The pole tube assembly 17 is provided in one piece and forms a technical unit with the central valve 3. The remaining external components of the magnetic circuit, the coil 18, the coil body 21, the housing 19 and the pole discs 31, 32 are statically connected directly or through an adapter in the non-moving engine component 20, like an e.g. cylinder head.

The coil 18 with its coil body 21, the pole discs 31, 32 and the housing 19 of the actuator 4 are radially centered by a sliding bearing 33 on the pole tube assembly 17 and axially fixed with minimum clearance. The sliding bearing 33 is configured in this embodiment from a non-ferrous base material, e.g. bronze with PTFE and can be advantageously encased by the remaining components through injection molding.

Figure 7:
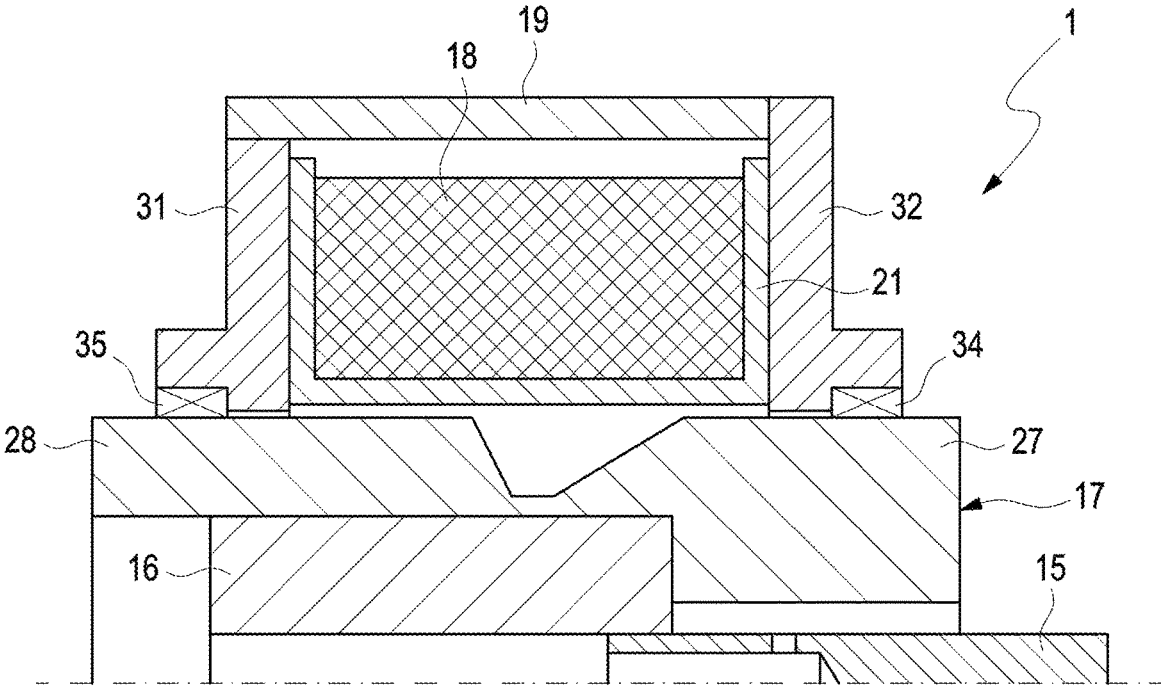
FIG. 7 illustrates a detail of a fourth embodiment of a kid according to the invention in a longitudinal sectional view.

In a fourth embodiment according to FIG. 7, two sliding bearings 34, 35 made from a ferrous base material are arranged axially outside of the magnetic circuit. This means the two sliding bearings 34, 35 are respectively arranged axially adjacent to the pole discs 31, 32 outside of the magnetic circuit.

As a matter of principle the sealing concept according to the invention is also useable in non-illustrated embodiments where the sleeve 22 or the pole core 27 is not attached at the central valve 3 itself but at a cam shaft end or attached torque proof at a component arranged at the cam shaft end as described supra.

What is claimed is:

1. A kit, comprising: a cam phaser, including a central valve that is configured to distribute a pressure fluid, and an actuator that controls the central valve, a rotor that is rotatably supported in a stator, wherein the cam phaser is driven or drivable by a dry running traction drive, wherein a pressure fluid distribution chamber that is fillable with the pressure fluid through the central valve is provided between the cam phaser and the actuator, wherein the pressure fluid distribution chamber is connected with an armature chamber of the actuator and sealed towards an ambient, wherein the actuator includes at least one armature that is movable by a coil, a pole core and a pole tube that form a pole tube assembly, and wherein the pressure fluid distribution chamber is sealed by a bonded or friction locking and form locking connection of the actuator or of at least one actuator component with the central valve.

2. The kit according to claim 1, wherein the armature of the actuator is axially movable in a sleeve, and wherein the sleeve is bonded to the central valve by welding or gluing.

3. The kit according to claim 2, wherein the sleeve is provided as a thin sleeve that is fabricated by a non-chipping method and that includes a plasma nitrogen hardened coating.

4. The kit according to claim 2, wherein the pole tube or the pole core includes axial centering ribs at an inside, and wherein the axial centering ribs are integrally molded in one piece with the pole tube or the pole core.

5. The kit according to claim 1, wherein the pole core of the actuator is bonded to the central valve by welding or gluing.

6. The kit according to claim 1, wherein the pole core of the actuator is connected with the central valve through friction locking and form locking by a press fit.

7. The kit according to claim 6, wherein the pole core forms the pole tube assembly together with the pole tube, wherein a non-magnetizeable spacer ring is provided between the pole tube and pole core, and wherein the non-magnetizeable spacer ring is produced by a thermal method and bonds the pole tube with the pole core.

8. The kit according to claim 6, wherein the pole core forms the pole tube assembly together with the pole tube, and wherein the pole tube and pole core are integrally provided into one piece.

9. The kit according to claim 6, wherein a coil body of the coil includes plural axial centering ribs on an inside of the coil body that are integrally molded with the coil body from a synthetic material.

10. The kit according to claim 6, wherein at least the coil with the coil body and a housing of the actuator are radially centered on the pole tube assembly by at least one sliding bearing.

11. The kit according to claim 10, wherein a single sliding bearing made from a non-ferrous base material is arranged between the coil body and the pole tube assembly.

12. The kit according to claim 10, wherein two sliding bearings made from a ferrous base material are arranged axially outside of a magnetic circuit.

13. The kit according to claim 1, wherein a seal element is provided between the cam phaser or the stator and the central valve.

14. The kit according to claim 1, wherein a bearing element is provided between the cam phaser or the stator and the central valve.

* * * * *